US005560095A

United States Patent [19]

Krüger

[11] Patent Number: 5,560,095

[45] Date of Patent: Oct. 1, 1996

[54] METHOD OF PRODUCING OF HOT ROLLED STRIPS OR PROFILES FROM A CONTINUOUSLY CAST PRIMARY MATERIAL

[75] Inventor: Bernd Krüger, Neuss, Germany

[73] Assignee: SMS Schloemann-Siemag Aktiengesellschaft, Düsseldorf, Germany

[21] Appl. No.: 545,544

[22] Filed: Oct. 19, 1995

Related U.S. Application Data

[63] Continuation of Ser. No. 135,839, Oct. 13, 1993, abandoned.

[30] Foreign Application Priority Data

Oct. 13, 1992 [DE] Germany ..... 42 34 454.9

[51] Int. Cl.[6] ..... B21B 1/46; B21B 13/22

[52] U.S. Cl. ..... 29/527.7; 29/33 C

[58] Field of Search ..... 29/33 C, 527.6, 29/527.7, DIG. 5, DIG. 21, DIG. 32; 72/200, 202; 164/269, 417, 476

[56] References Cited

U.S. PATENT DOCUMENTS

| | | | |
|---|---|---|---|
| 5,035,036 | 7/1991 | Bohnenkamp | 29/527.7 |
| 5,075,953 | 12/1991 | Braud | 29/527.7 |
| 5,115,547 | 5/1992 | Rohde | 29/527.6 |
| 5,182,847 | 2/1993 | Guse et al. | 29/527.7 |
| 5,305,515 | 4/1994 | Fastert et al. | 29/527.7 |
| 5,467,518 | 11/1995 | Mertens | 29/33 C |

FOREIGN PATENT DOCUMENTS

| | | | |
|---|---|---|---|
| 3741220 | 6/1989 | Germany | 29/33 C |

*Primary Examiner*—David P. Bryant
*Attorney, Agent, or Firm*—Anderson Kill Olick & Oshinsky, P.C.

[57] ABSTRACT

A method of producing hot-rolled strips and hot-rolled profiles from a continuous, continuously casted primary material, in which single slabs are transported from the buffer zone into a ferry which transports them by being transversely displaced from the casting line into the pitch line extending parallel to and spaced form the casting line, where it is stored in an accumulator furnace located parallel to an equalizing furnace and which is offset relative thereto, with the single slabs, upon request, being transported by a ferry from the accumulator furnace into the finishing train for finish-rolling the end product.

3 Claims, 3 Drawing Sheets

METHOD OF PRODUCING OF HOT ROLLED STRIPS OR PROFILES FROM A CONTINUOUSLY CAST PRIMARY MATERIAL

This is a continuation application of Ser. No. 08/135,839, filed Oct. 13, 1993, now abandoned.

FIELD OF THE INVENTION

The present invention relates to production of hot rolled strips and more particularly to a method and an apparatus for producing of hot-rolled strips or profiles from continuously cast primary material in successive steps in a finishing train.

BACKGROUND OF THE INVENTION

In modern continuous production arrangements, the primary material provides for obtaining thin slabs, which are rolled down in a finishing train and which have a thickness of less than 70 mm, preferably 50 mm. The slabs are separated from a continuous cast piece, which is extruded in a continuous casting machine and have a length corresponding to the coil-weight of the finished hot-rolled wide strip. The casting speed of the continuous casting machines for continuous casting of thin slabs is relatively small, whereas the feed speed of the associated continuous finishing train for hot-rolled wide strip is two to four times faster than the casting speed. Therefore, it is advantageous when two casting machines are associated with a single finishing train, so that slabs are alternatively cut off from two continuously cast pieces from two casting machines and are then transported, respectively, to the finishing train for rolling down. The slab is brought into alignment with the finishing train for producing a hot-rolled wide strip from respective casting machines by two longitudinal/transverse/longitudinal transportation systems, so-called "ferries", and then the slabs are rolled down in the finishing train. In a conventional embodiment of such an arrangement, these two single-strand continuous casting machines are associated each with an equalizing furnace and a "ferry" with two strands being associated with a common holding furnace, which is arranged upstream of the continuous finishing train. Each equalizing furnace has a heating zone, a buffer zone and an accumulating furnace part. In the heating zone, the slabs are brought up to a rolling temperature. The buffer zone is necessary to insure a selective transverse transportation of the slabs from both casting machines into the finishing train in the required transportation time. The accumulating furnace part provides for compensation of a dead time of the finishing train, resulting from, e.g., changing rollers or a disturbance, without the interruption of the production of the continuously cast slabs.

With such arrangement, e.g., the thickness of the slab is 50 mm, the width is 1550 mm, the length is 44 m, the casting speed is 5.5 m/min, and the feed speed of the continuous finishing train for producing a hot-rolled wide strip is 0.29 m/sec. or 17.4 m/min. Here, the ratio of the feed speed to the casting speed is greater than 3.2. With this, the length of the heating zone is about 40 m, the length of the buffer and the accumulator part, taken together, is 105 m, the length of the "ferry" is 49 m, and the length of the holding furnace is 49 m. With these parameters, the length of the furnace installation is about 147 m and, if the length of the "ferry" is included, 194 m, so that the total length, together with the holding furnace, is 245 m. An arrangement of such a length is extremely costly and requires a respectively large surface area. To eliminate this drawback, a novel arrangement concept for the production of steel strip is suggested in European application EP 0 413 169 A1. To reduce the investment expenditure and the requirement in a surface area, as well as for improving the temperature regime, the finishing train is sidewise offset with respect to the output conveyor of the steel strip casting installation, and an intermediate temperature equalizing furnace is arranged sidewise of the equalizing furnace of the casting installation and is offset relative thereto forward in the direction of movement of the seal toward the finishing train. The three equalizing furnaces which extend parallel to each other, are connected by an end face transverse transporting device. The drawback of this arrangement is that the one-time reversal of the transportation direction of the slab results in different dwell time of the front portion of the slab and the rear portion of the slab in the equalizing furnace, and, thereby, in a non-uniform temperature gradient along the slab length. A further drawback of this arrangement concept is that the furnace installation should extend below the casting installation.

An object of the invention is a method of and an apparatus for producing hot-rolled strips or profiles from a continuously cast primary material, which would eliminate the foregoing drawbacks of the known process and arrangement, with comparatively smaller length of the furnace installation, reduced investment expenditure, and a need in a smaller surface area.

SUMMARY OF THE INVENTION

These and other objects of the invention, which shall become hereafter apparent, are achieved by a method of producing hot rolled strips or profiles from a continuously cast primary material, in which the cast piece is transported, from the buffer zone, into a "ferry" which transports it from the casting line into the pitch line, where it is stored in an accumulator furnace located next to an equalizing furnace and which is offset relative thereto in the direction of conveying of the primary material. Upon request, the cast piece (slab) is transported by a "ferry" from the accumulator furnace into the finishing train for finish-rolling the end product.

If required, a holding furnace is arranged between the accumulator furnace and the finishing train.

The different embodiments of the invention are set forth in dependent claims. Because the slab is loaded not into an accumulator furnace arranged in the casting line, but rather into an accumulator furnace, which is arranged in the pitch line and is offset in the direction of movement of the primary material relative to the equalizing furnace, the length of the equalizing furnace for this process can be reduced, at least by the length of an accumulator furnace part of about 55 m, from a total length of 147 m to a total length of 92 m. Thereby, such an apparatus provides, together with the elimination of the above-mentioned drawbacks of the prior art arrangement, for lower investment expenditure and requires a smaller surface area.

An apparatus for producing of hot-rolled strips and profiles from a continuously cast primary material in successive steps in a finishing train for effecting the process according to the invention, comprises two continuous casting lines, including each a continuous casting machine, an equalizing furnace and a "ferry" and a continuous finishing train, which is offset sidewise relative to the casting lines and includes a holding furnace, wherein each equalizing furnace has a heating zone, a buffer zone, and a furnace part, which is formed as an accumulator for compensating the dead time of the finishing train, without the interruption of production of the continuously cast material, and wherein the accumulator furnace part is arranged in the pitch line and is sidewise offset relative to the equalizing furnace of the casting line.

The objects, features and advantages of the present invention will become apparent from the following description of the invention with reference to the drawings, which show, schematically, different embodiments of the invention.

BRIEF DESCRIPTION OF THE DRAWINGS

The invention will be better understood by the Detailed Description of the Preferred Embodiments in connection with the Drawings, of which.

DETAILED DESCRIPTION OF THE PREFERRED EMBODIMENTS

Figure 1:
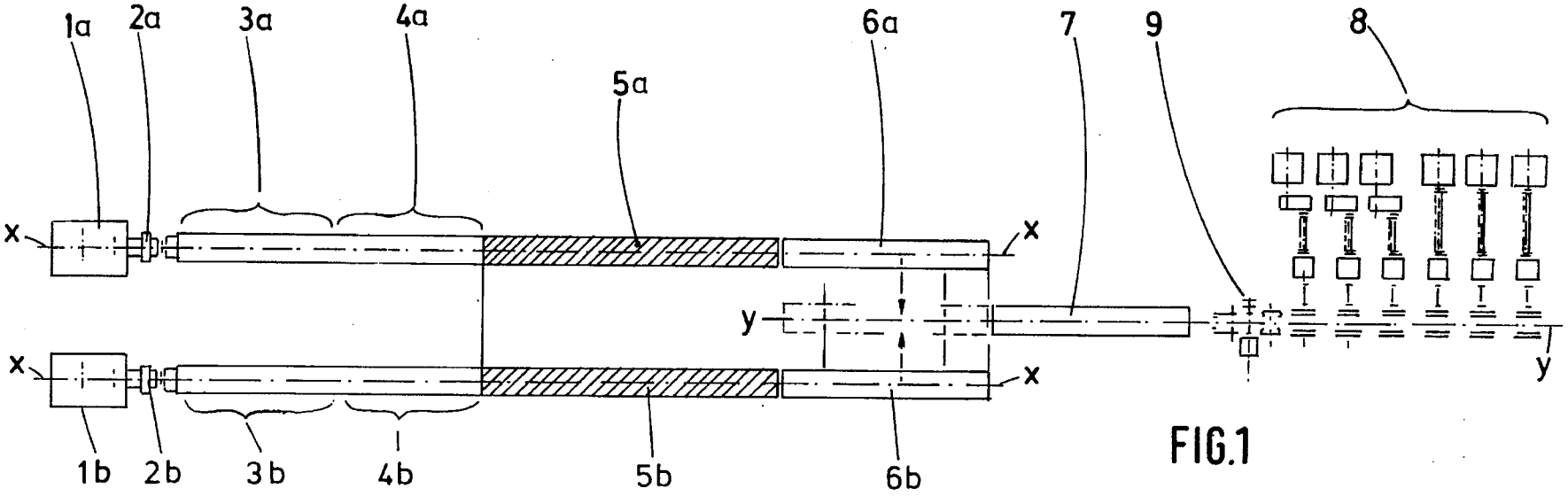
FIG. 1 shows an apparatus with two casting machines, with a long-range equalizing furnace arranged downstream of each casting machine, and a pitch line comprising a continuous finishing train.

Referring now to the drawings, wherein like numerals reflect like elements, throughout the various views, the FIG. 1 apparatus includes two identical casting lines X—X and a pitch line Y—Y. In each casting line, there are arranged a casting machine 1*a*, 1*b* and adownstream located shear 2*a*, 2*b* for separating a cast piece into single slabs. Downstream of each shear, there is a long-range equalizing furnace installation having a heating zone 3*a*, 3*b*, a buffer zone 4*a*, 4*b* and an accumulator zone 5*a*, 5*b*. In the shown arrangement, the length of the heating zone 3*a*, 3*b* is about 40 m, the length of the buffer zone 4*a*, 4*b* is also about 40 m, and the length of the accumulator zone 5*a*, 5*b* is about 67 m. The total length of each of the equalizing furnace is about 147 m. Downstream of each equalizing furnace, there is arranged a transverse transporting system comprising a "ferry" 6*a*, 6*b* having a length of about 49 m. Between the two casting lines X—X, there is located a pitch line Y—Y, including a holding furnace 7 having a length of about 49 m, and a finishing train 8. The finishing train comprises three roughing stands, three finishing stands, and an input device 9, which is located at the inlet of the finishing train.

Figure 2:
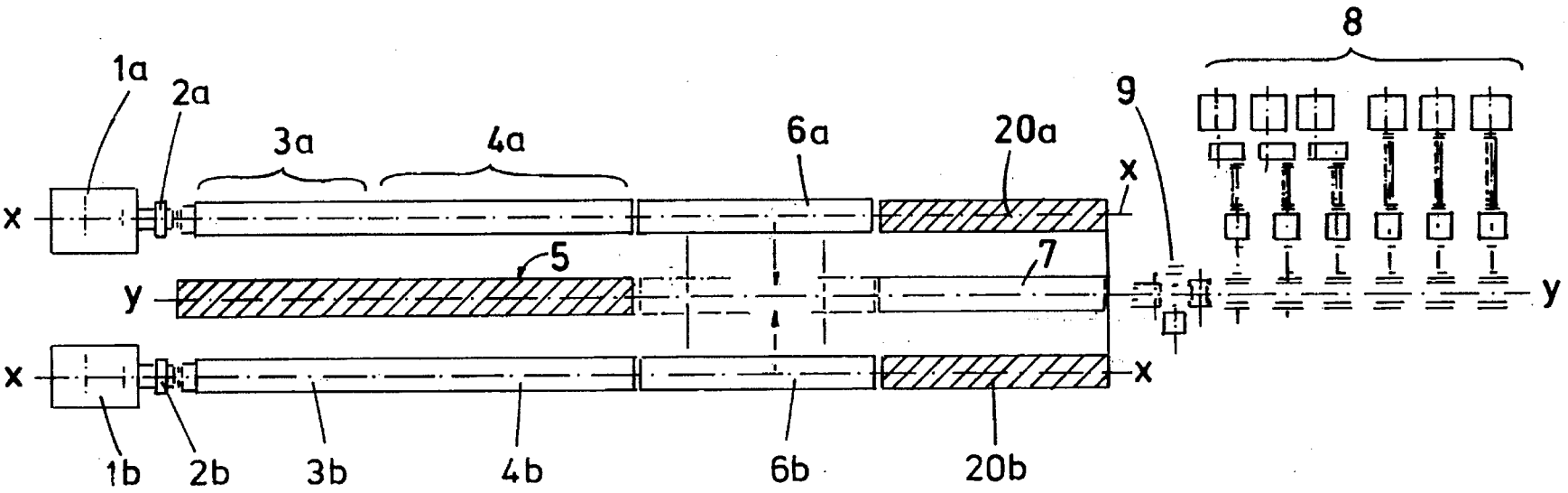
FIG. 2 shows an apparatus with two parallel casting lines with a reduced-length equalizing furnace, and an accumulating furnace arranged coaxially with the finishing train.

The apparatus according to the invention, shown in FIG. 2 has, in both casting lines X—X, a reduced-length equalizing furnace consisting of a heating zone 3*a*, 3*b* and a buffer zone 4*a*, 4*b*. The length of the heating zone 3*a*, 3*b* is about 40 m and the length of the buffer zone 4*a*, 4*b* is about 50 m. Thereby, the length of the equalizing furnace shown in FIG. 2 is reduced in comparison with the length of the equalizing furnace shown in FIG. 1, and is about 92 m, whereas the length of the equalizing furnace shown in FIG. 1 is, as described above, 147 m. According to the invention, the accumulator furnace 5 is arranged in the pitch line Y—Y sidewise of equalizing furnaces 3*a*, 4*a* and 3*b*, 4*b*. Thereby, the length of the arrangement is reduced, from the shears 2*a*, 2*b* to the end of the holding furnace 7, from 245 m to 190 m. At that, the accumulator furnace 5 extends parallel to the heating and buffer zones. As shown in FIG. 2, the apparatus layout permits increasing the length of the buffer zone from 40 m to about 50 m and increasing the length of the accumulator furnace from 67 m to 80 m. As to the "ferries", the holding furnace 7 and the finishing train, their lengths remain unchanged.

It is envisaged, according to the invention, to provide at least in one casting line, and advantageously in both, an additional accumulating furnace 20*a*, 20*b*. By providing the additional furnaces, without lengthening the total length of the apparatus, it becomes possible to increase the compensation time when the finishing train does not operate as a result of changing of the rollers or disturbance, with cast length of about 50 m, in two times, by about 9 minutes.

Figure 3:
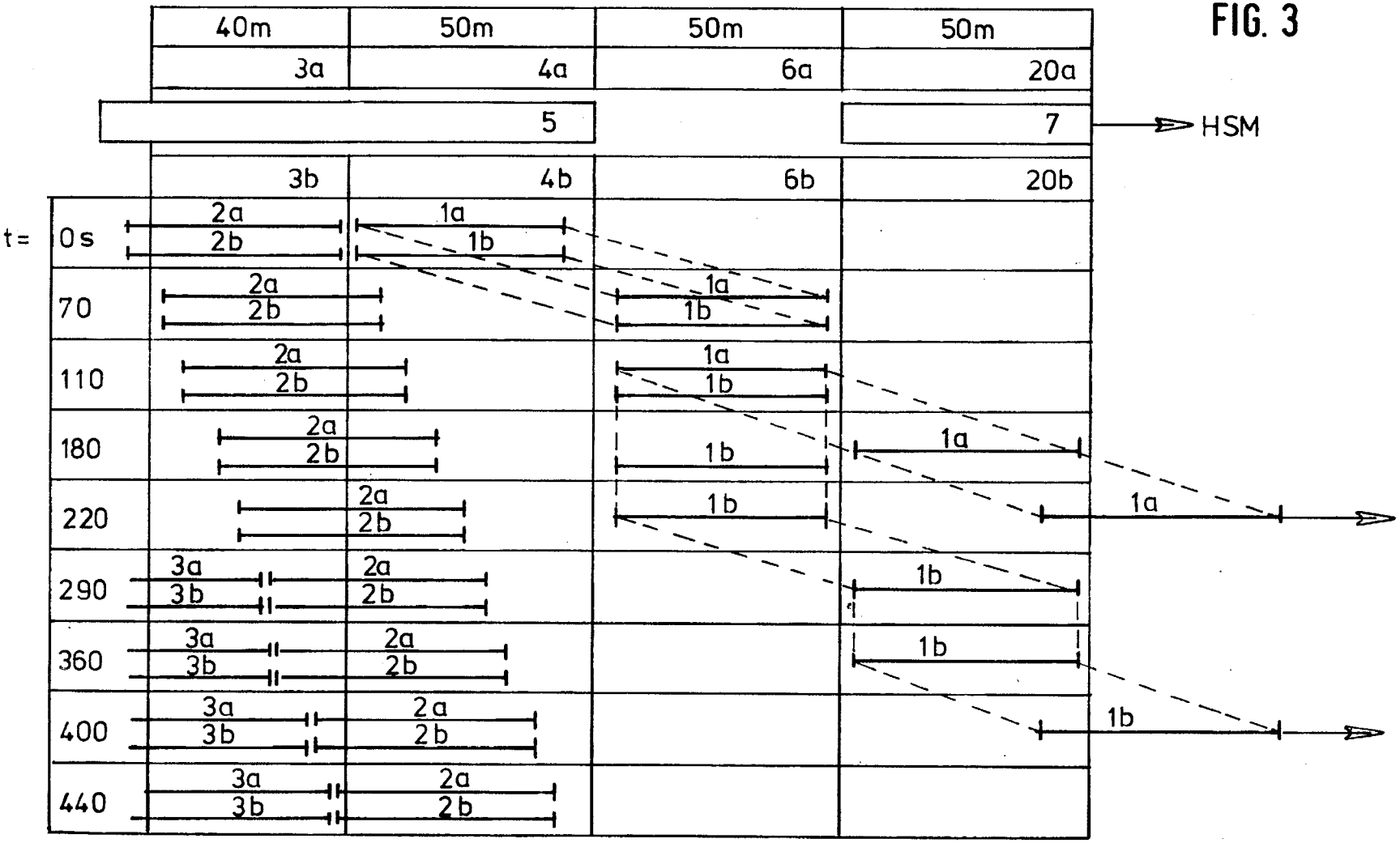
FIG. 3 shows an operational diagram of the apparatus shown in FIG. 2 in the form of a path/time network.

The path/time network of the apparatus is shown in FIG. 3. The top portion indicates the total length of about 190 m of the heating zone 3*a*, 3*b*, the buffer zone 4*a*, 4*b*, the "ferries" 6*a*, 6*b*, and the additional accumulating furnace 20*a*, 20*b* of the casting line X—X, as well as the respective lengths of the accumulating and holding furnaces of the pitch line. The example shows two slabs (2*a*, 2*b*) at the time point zero at the end of the heating zones 3*a*, 3*b* and two slabs (1*a*, 1*b*) in the buffer zones 4*a*, 4*b*. At the time point t=70 sec., the slabs (1*a*, 1*b*) have advanced forward, at the transportation speed of 0.75 m/sec., and have moved into the "ferries" 6*a*, 6*b* by 52.5 m. At the time point t=110 sec., the slab(la), which is located in the "ferry" 6*a*, is transported, with a speed of 0.25 m/sec., from the casting line to a pitch line Y—Y in 40 sec. by about 10 m with the "ferry" 6*b* remaining in its casting line X—X. At the time point t=180 sec., the slab (1*a*) is transported from the "ferry" 6*a* into the holding furnace 7. Then, at the time point t=220 sec., after being transported by another 30 m, the slab is in the finishing train 8. At feed speed of 0.29 m/sec., the slab (1*a*) is conveyed through the finishing train 8 in about 152 sec. At the casting speed of about 0.1 m/sec. and with the length of the slab of 44 m, the production of the slab takes 440 sec. When the casting pieces are produced continuously in two casting lines, an offset time cycle of 220 sec. for each slab (1*a*, 1*b*) is available. Between the finishing time of 152 sec. and a production cycle of 220 sec. for a single slab, there is, after each finishing cycle of 152 sec., a clear interval of 68 sec. Thus, there is a general cycle sequence such that the total cycle expires within 450 sec., within which two slabs are produced and rolled down into an end product. As can be seen in the diagram, between the time points t=0 and t=440 sec., a slab pair (1*a*, 1*b*) or (2*a*, 2*b*) is cast and is transported by 45 m from the heating zones 3*a*, 3*b* into the buffer zones 4*a*, 4*b*. Between the time points t=180 sec. and t=220 sec., the slab (1*b*), by a "ferry" 6*b*, is transported from the casting line X—X into the pitch line Y—Y, and then between the time points t=220 sec. and t=290 sec. that is in 70 sec., is transported from the "ferry" 6*a*, 6*b* by 52.5 m either backward into the accumulating furnace or forward in the holding furnace 7. There, the slab 1*b* is held up to the time point t=330 sec., that is for 40 sec., and then is transported, between the time points t=330 sec. and t=370 sec., by another 30 m into the inlet of the finishing train 8. Thereafter, the cycle is repeated at t=450 sec. =t=0, wherein instead of positions (2*a*, 2*b*) or (1*a*, 1*b*), after another cycle of 450 sec., the slabs (3*a*, 3*b*) and (2*a*, 2*b*) by about 44 m, in accordance with the casting speed of about 0.1 m/sec., are advanced.

From the diagram of FIG. 3, it follows that the operational process of the apparatus according to the present invention is characterized by a rapid run, wherein between two respective finishing cycles of a total length of 304 sec., an interval of 136 sec. or 2×86 sec. is customary. The resulting idle time permits driving the drive means of the finishing train stands during each rolling operation for 152 sec. at a heavy-duty level, without thermally overloading the electric motors. The diagram shows, on the other hand, that an addition of a third casting line is not appropriate any more. With a sufficient storage capacity within the arrangement, the shortened layout of the furnace installation according to the inventions provides for sufficient compensation time to insure a continuous production, during changing of rollers or other dead time of the finishing train, of the casting machines, at least to the end of one or two loading of the casting machines.

While the preferred embodiments of the invention have been disclosed in detail, modifications and adaptations may be made thereto without departing from the spirit and scope of the invention as delineated in the following claims.

What is claimed is:

1. A method of producing hot-rolled strips and hot-rolled profiles from a continuous, continuously cast primary material in successive steps in a finishing train, said method comprising the steps of:

separating a continuous, continuously cast primary material, after its solidification, into single slabs;

heating the single slabs in a heating zone of an equalizing furnace, located in a casting line, to a rolling temperature;

transporting the single slabs from the heating zone into a buffer zone of the equalizing furnace;

transporting the single slabs from the buffer zone into a ferry located downstream of the buffer zone and transporting the single slabs, by transversely displacing the ferry, from the casting line into a pitch line extending parallel to and spaced from the casting line;

thereafter, transporting the single slabs into an accumulator furnace, which is arranged in the pitch line sidewise of the equalizing furnace and upstream of the ferry;

upon request, transporting the single slabs from the accumulator furnace of the pitch line back into the ferry and from the ferry into the finishing train; and finish-rolling the single slabs in the finishing train for obtaining an end product.

2. The method of claim 1, wherein said step of transporting the single slabs from the accumulator furnace into the finishing train includes the step of transporting the single slabs from the accumulator furnace to a holding furnace, which is located downstream of the accumulator furnace and upstream of the finishing train, and from the holding furnace into the finishing train.

3. The method of claim 1, further comprising the steps of:

transporting some of the single slabs from the buffer zone into the ferry and from the ferry into an accumulator furnace located in the casting line, and transporting, after a request, the same slabs from the accumulator furnace of the casting line back into the ferry for transporting the same slabs from the casting line into the pitch line; and thereafter, transporting the same slabs into the finishing train for finish-rolling the same slabs.

* * * * *